United States Patent [19]

Seiki et al.

[11] 4,299,084

[45] Nov. 10, 1981

[54] OPEN END ROTOR FOR A SPINNING MACHINE

[75] Inventors: Kazuo Seiki, Kariya; Takashi Katoh, Toyota; Yoshiaki Yoshida, Ohbu, all of Japan

[73] Assignee: Kabushiki Kaisha Toyoda Jidoshokki Seisakusho, Kariya, Japan

[21] Appl. No.: 148,039

[22] Filed: May 6, 1980

[30] Foreign Application Priority Data

May 14, 1979 [JP] Japan ..... 54-62990[U]

[51] Int. Cl.[3] ..... D01H 1/135

[52] U.S. Cl. ..... 57/58.89

[58] Field of Search ..... 57/58.89–58.95

[56] References Cited

U.S. PATENT DOCUMENTS

| | | | |
|---|---|---|---|
| 3,520,122 | 7/1970 | Shepherd | 57/58.89 |
| 3,812,667 | 5/1974 | Marsalek et al. | 57/58.89 |
| 3,822,541 | 7/1974 | Croasdale et al. | 57/58.89 |
| 4,058,964 | 11/1977 | Stalder | 57/58.89 |
| 4,237,682 | 12/1980 | Miyamoto | 57/58.89 |

*Primary Examiner*—Donald Watkins

*Attorney, Agent, or Firm*—Haseltine and Lake

[57] ABSTRACT

A spinning machine is disclosed, which generally comprises a spinning rotor having a frusto-connical fiber sliding surface consisting of a first fiber sliding portion, onto which discrete fibers are first supplied, and a second fiber sliding portion connected to the first fiber sliding portion, a bottom surface, and a fiber collecting groove formed between the second fiber sliding portion and the bottom surface. The spinning machine further comprises a yarn take-up tube centrally extending into the spinning rotor to take up a spun yarn therethrough.

The first fiber sliding portion forms an angle ($\alpha$) with a plane of rotation of the spinning rotor larger than an angle ($\beta$) formed by the second fiber sliding portion with respect to the same plane. The bottom surface of the spinning rotor includes a fiber guide portion, which forms the fiber collecting groove in cooperation with the second fiber sliding portion and is inclined at an angle ($\delta$) with respect to the plane of rotation. This angle ($\delta$) is so selected as to fulfill the condition $\delta=\epsilon\pm$ about 5°, where angle $\epsilon$ is a measure of the inclination of the yarn taking off line, with respect to the plane of rotation, connecting the lowermost point of the yarn take-up tube with an intersection of the second fiber sliding portion and the fiber guide portion.

5 Claims, 7 Drawing Figures

OPEN END ROTOR FOR A SPINNING MACHINE

BACKGROUND OF THE INVENTION

This invention relates generally to improvements in a spinning rotor for an open end spinning machine, and more particularly to the prevention of the excessive accumulation of impurities in the spinning rotor.

As is known, the rotor for an open end spinning machine is generally provided with an annular wall surface which extends from the rim of an open end of the rotor radially outwardly from the rotary axis and downwards to a region of maximum diameter, where a fibre collecting surface is formed onto which the fibers are collected. Open end spinning machines employing the abovementioned rotors are widely in use for mass production of yarn and are required to be capable of continuous high speed spinning operation for a long duration. However, the spinning rotors in open end spinning machines are in fact supplied with separated fibers, which contain a certain amount of small impurities, such as dust, husks and the like. Even if such impurities entering the spinning rotor with the fibers are rolled into a yarn, there will be no influence upon the yarn quality, because critical impurities such as those causing yarn breakage have been removed before the fibers enter the spinning rotor, i.e., during the carding and drawing. However, the spinning rotor itself faces a serious problem which must be solved in order to allow it to continuously operate at high speed for a long duration.

In open end spinning machines, since the fibers are fed into the spinning rotor in the separated or opened state, the impurities mixed with the fibers can move in such a way that they are substantially released from restriction by the separated fibers. The impurities once separated from the fibers are difficult to re-mix with the fibers which have been deposited in the fiber collecting region of the spinning rotor in the form of a sliver or fiber ring, because of the difference in physical properties between the impurities and fibers. That is, the impurities generally have a greater mass than the fibers and therefore they are caused to move into the fiber collecting groove by the action of a centrifugal force stronger than that acting on the fibers, with the result that the impurities are deposited and accumulated in the region of maximum diameter or narrowest portion of the fiber collecting groove, while the fibers are positioned on the inner side of the impurities, i.e., on the side adjacent to the rotation axis of the spinning rotor. Therefore, when the fibers are removed by twisting them into a tail end of a yarn, it is difficult to cause the impurities on the outer side to be rolled in the twisted yarn especially where the impurities have a cubic shape. The impurities which thus remain in the region of maximum diameter of the fiber collecting groove are compressed by the strong action of centrifugal force and gradually develop, during a lengthly spinning operation, into a layer of deposition of considerable thickness due to the wedge-shaped configuration of the fiber collecting groove. This causes the radius of the maximum diameter region of the groove, i.e., the wedge's tip to become larger than the initial, most favourable radius. The fiber ring in the fiber collecting groove becomes expanded in width and is subject to less twisting action. This seriously affects the quality of the spun yarn and invites yarn irregularities, less yarn twist and decreased yarn strength.

It is of course essential for the high speed open end spinning to apply sufficient twisting action on the fiber ring, and therefore loss of twist due to the deposition of the impurities makes it difficult to carry out high speed spinning.

In view of these facts, there have been proposed various designs for a spinning rotor with a self-cleaning capability, which enables the impurities entering the spinning rotor with the opened fibers to be positively rolled in the sliver or fiber ring in the fiber collecting groove thereby removing from the spinning rotor. However, with the prior art designs, when it is attempted to decrease the amount of impurities accumulated in the groove, the strength of the spun yarn too is decreased, and it has been difficult to greatly decrease the amount of accumulated impurities while retaining yarn strength at or above a desired level.

U.S. Pat. No. 4,058,964 discloses one example of such prior art designs, wherein a fiber collecting groove is formed by two surfaces defining an angle of aperture of 45° to 90°. The bottom of the groove is of a radius of from 0.1 to 0.5 millimeters. Also, the biscator of the angle of aperture forms an angle with the plane of rotation of the groove of a value of from 0° to 45° while the yarn take-off direction forms an angle with the plane of rotation of from 0° to 25°. Although this spinning rotor can reduce the accumulation of impurities to a relatively low level, it involves the disadvantage that when the fibers in the groove are twisted into the tail end of a yarn being wound onto a package, they must be in frictional contact with a very limited portion of the bottom surface of the spinning rotor and therefore are oblidged to undergo strong abrasion resistance, resulting in an increased rate of yarn breakage, and production of a flutty yarn.

Furthermore, a spinning rotor as shown in FIG. 1 has been known, which has an inner surface 3 comprising a first frusto-conical portion 1 extending downwardly and outwardly, and a second frusto-conical portion 2 extending upwardly and outwardly to form a V-shaped groove 4 in cooperation with the first portion 1. In this spinning rotor of FIG. 1, since there is a large difference between angles $\alpha$ and $\beta$ which first and second fiber sliding parts 1*a* and 1*b* form respectively with the plane of rotation of the spinning rotor, when individual fibers first supplied onto the first fiber sliding part 1*a* reach the junction between the first and second parts 1*a* and 1*b* and are transferred to the second fiber sliding part 1*b*, they are obliged to undergo a rapid change in their travel direction and accordingly a relatively great shock, so that the fiber orientation or arrangement in the fiber collecting groove will be disturbed, resulting in reduced yarn strength.

Also, in this spinning rotor of FIG. 1, since the second frusto-conical portion 2 positioned below the plane of rotation of the maximum diameter portion of the groove 4 forms an angle $\gamma$ with said plane, the groove angle is greatly increased to the value $\beta$ plus $\gamma$ thereby increasing a possibility that the impurities and collected fibers in the groove 4 may be separated from each other, resulting in a decreased "rolling-in" rate of impurities into the fibers. Moreover, as is apparent to those skilled in the art, the collected fibers in the groove 4 are removed therefrom to form the tail end of a spun yarn 5, which is continuously taken up through a yarn take-up tube 6 from the spinning rotor. At that time, with the spinning rotor of FIG. 1, it is difficult to cause the impurities, which may present in the space defined between the yarn leading to the yarn take-up tube 6 and the second frusto-conical portion 2, or at least the space covered by the angle Γ, to be rolled in the yarn, since the line, along which the yarn is removed from the groove 4 through the yarn take-up tube 6, is positioned considerably above the plane of rotation of the maximum diameter portion of the groove 4.

It will, therefore, be understood that, with the spinning rotor shown in FIG. 1, if the angle $\beta$ is designed to be of a relatively great value in order to increase the yarn strength, the amount of impurities collected in the groove will be greatly increased. In other words, it will not be possible to decrease the amount of impurities collected in the groove without decreasing the yarn strength.

It is accordingly a principal object of this invention to provide a spinning rotor for an open end spinning machine, which has a greatly increased self-cleaning capability so that the accumulation of impurities in the groove can be greatly decreased with the yarn strength maintained above the required level.

SUMMARY OF THE INVENTION

In brief, an open end spinning machine according to this invention generally comprises a spinning rotor having a frusto-conical fiber sliding surface consisting of a first fiber sliding portion, onto which discrete fibers are first supplied, and a second fiber sliding portion connected to the first fiber sliding portion, a bottom surface, and a fiber collecting groove formed between the second fiber sliding portion and the bottom surface. The spinning machine further comprises a yarn take-up tube centrally extending into the spinning rotor to take up a spun yarn therethrough.

The first fiber sliding portion forms an angle ($\alpha$) with a plane of rotation of the spinning rotor larger than an angle ($\beta$) formed by the second fiber sliding portion with respect to the same plane. The bottom surface of the spinning rotor includes a fiber guide portion, which forms the fiber collecting groove in cooperation with the second fiber sliding portion and is inclined at an angle ($\delta$) with respect to the plane of rotation. This angle ($\delta$) is so selected as to fulfill the condition $\delta=\epsilon\pm$ about 5°, where angle $\epsilon$ is a measure of the inclination of the yarn taking off line, with respect to the plane of rotation, connecting the lowermost point of the yarn take-up tube with an intersection of the second fiber sliding portion and the fiber guide portion.

BRIEF DESCRIPTION OF THE DRAWINGS

This invention will become more readily apparent from the following description of the preferred embodiment shown, by way of example only, in the accompanying drawings, wherein.

DESCRIPTION OF THE PREFERRED EMBODIMENT

Figure 2:
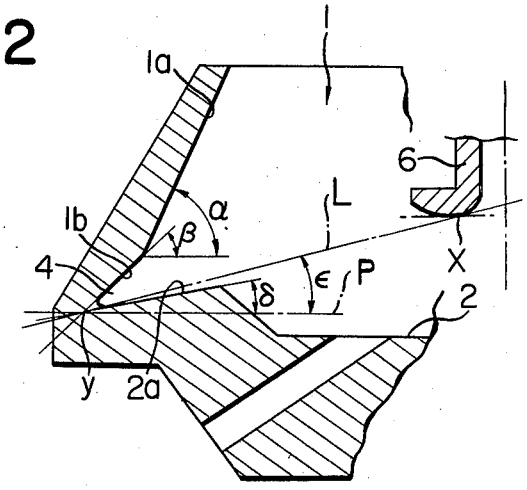
FIG. 2 is a view, corresponding to that of FIG. 1, showing the geometry of a spinning rotor according to this invention.

Referring to FIG. 2, there is shown a spinning rotor according to the invention, which generally has an inner, frusto-conical fiber sliding surface 1, a bottom surface 2 and a fiber collecting groove 4 formed therebetween. The inner surface 1 comprises a first fiber sliding portion 1*a*, onto which discrete fibers are first supplied and which forms an angle $\alpha$ with the plane of rotation of the spinning rotor, and a second fiber sliding portion 1*b* connected to the first portion 1*a* and forming an angle $\beta$ with the plane of rotation of the spinning rotor. With respect to the angles $\alpha$ and $\beta$, it is noted that the angle $\beta$ should preferably approach as nearly as possible the angle $\alpha$ so that the fiber arrangement will not be particularly disturbed when the fibers slide down across the junction between the first and second fiber sliding portions 1*a* and 1*b*. However, in order to decrease an amount of impurities collected in the groove 4, it is preferable, as apparent from the disclosure of the co-pending U.S. Pat. No. 4,237,682 entitled "Open-End Rotor for a Spinning Machine" and assigned to the same assignee as the present application, that some difference exists between the angles $\alpha$ and $\beta$ to provide a stepped portion at the junction between the first and second fiber sliding portions 1*a* and 1*b* thereby causing the impurities to be forcibly separated from the sliding down fibers at the stepped portion due to the differenctial force of inertia acting on the impurities and fibers. The angle $\alpha$, at which the first fiber sliding portion 1*a* is inclined with respect to the plane of spinning rotor's rotation, is limited to 55°-75° in order that a sliding speed of the fibers directed toward the fiber collecting groove 4 can be maintained at a desirable level. With respect to the difference between the angles $\alpha$ and $\beta$, which conflicts with the yarn quality and the amount of collected impurities as understood from the foregoing, it should be limited to 10°-35° so that both the yarn quality and the amount of collected impurities are not significantly influenced for the worse by this difference, as disclosed in said co-pending application.

According to this invention, a yarn guide portion 2*a* of the bottom surface 2, which is in opposition to the second yarn sliding portion 1*b* to form the groove 4 therebetween, is positioned above a plane P of rotation including an intersection y of either the second yarn sliding portion 1*b* and the yarn guide portion 2*a* in the case of the groove radius=O, or extension lines thereof where the groove has any radius, and the yarn guide portion 2*a* forms an angle $\delta$ with the plane P of rotation. This angle $\delta$ is in the range of +5° to −5° with respect to an angle $\epsilon$ included between the plane P of rotation and a line L connecting the intersection y with the lowermost point x of the yarn take-up tube 6, i.e., the yarn take-off direction from the groove 4. Since the yarn guide portion 2*a* is positioned above the rotation plane P, the angle of the groove 4 included between the second yarn sliding portion 1*b* and the yarn guide portion 2*a* can be decreased to the value of $\beta-\delta$, resulting in an increased "rolling-in" rate of impurities into the yarn. Moreover, because the angle $\delta=\epsilon\pm5°$, the twisted yarn (FIG. 3), which is removed from the groove 4 and connected to the tail end of the yarn while being twisted, is allowed to properly contact the yarn guide portion 2*a*. This means that substantially no space exists between the twisted yarn and the yarn guide portion 2*a* and therefore the impurity "rolling-in" rate can be further increased.

Figure 3:
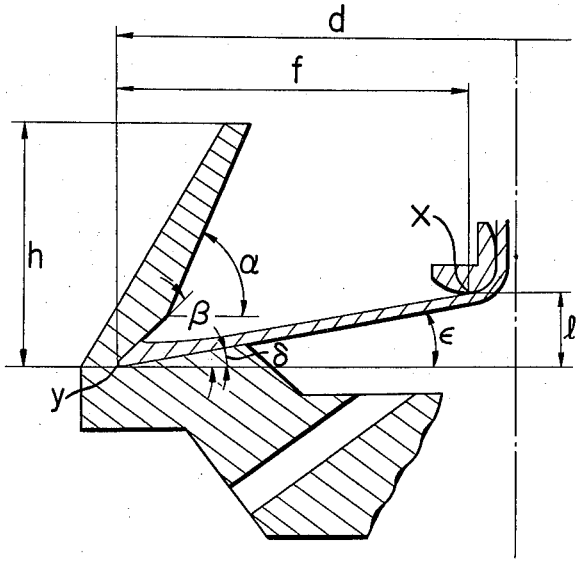
FIG. 3 is a fragmental sectional view of a spinning rotor according to this invention, with which operation experiments have been performed.

The present inventors have performed many experiments with both the prior art spinning rotors and the improved spinning rotors of this invention shown in FIGS. 2 and 3. The results of the experiments are illustrated in FIGS. 4 to 7.

The spinning rotor shown in FIG. 3 has a maximum inner diameter d=48 mm, vertical distance h=10.5 mm (which is a measure from the intersection y to the opening of the spinning rotor), vertical distance l=3.8 mm (which is a measure from the lowermost point x of the yarn take-up tube to the plane of rotation of the intersection y), and horizontal distance f=19.5 mm (which is a measure from the intersection to the lowermost point x). These numerical values are merely illustrative of one example of the arrangement according to this invention and therefore may be varied broadly. For example, the maximum inner diameter d may be 35 to 90 mm, and the vertical distance h may be 8 to 15 mm. The vertical distance l, also, may be varied depending upon the dimensions of both the spinning rotor and the yarn take-up tube. It is therefore understood that various combinations of these numerical values may obtain in practice. For example, the typical spinning rotor may have a set of values d=68 mm, h=10.5 mm, l=4 mm, f=29.5 mm, and $\epsilon=7.7°$; or d=49 mm, h=10.5 mm, l=4 mm, f=16.5 mm, and $\epsilon=13.6°$, in addition to the afore-mentioned set of values.

Figure 1:
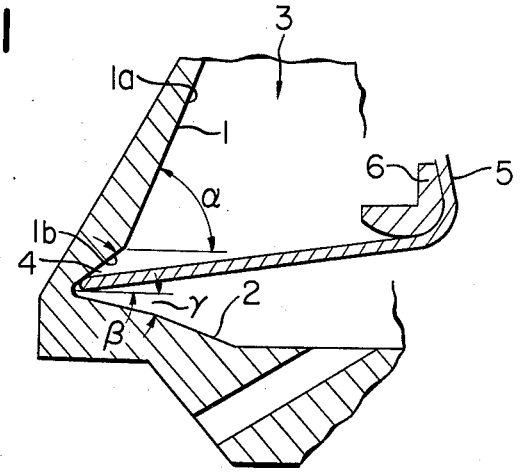
FIG. 1 is a fragmental sectional view, in elevation, showing one example of the prior art spinning rotors.
Figure 4:
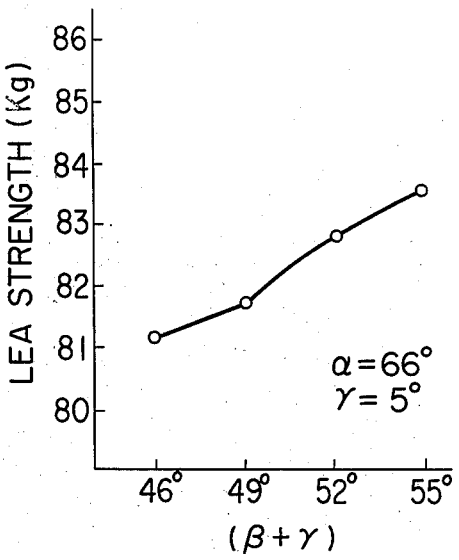
FIGS. 4 and 5 are graphs showing experimental results obtained with respect to the prior art spinning rotor of FIG. 1 and explaining respectively changes in Lea strength and amount of collected impurities when an angle $\beta+\gamma$ changes.

As apparent from FIG. 4 showing the results of the experiments with the prior spinning rotor shown in FIG. 1, the smaller the difference between the angles $\alpha$ and $\beta$, the greater the yarn strength. This is because, when the differential angle becomes high, the fibers sliding down across the junction of the first and secnd fiber sliding portions 1*a* and 1*b* turn abruptly at the junction, whereby they are caused to be deposited in the fiber collecting groove in a random arrangement, resulting in poor yarn quality. On the other hand, the more the angle $\beta+\gamma$, i.e., the angle of the groove aperture, the more the impurities are accumulated in the groove 4. This proves that, when the angle $\beta+\gamma$ is too large, it becomes difficult to cause the impurities, which may present in the space defined between the yarn leading to the yarn take-up tube 6 and the bottom surface 2, or at least the space covered by the angle $\gamma$, to be rolled into the yarn, since the yarn taking off line, along which the yarn is removed from the groove through the yarn take-up tube 6, is positioned considerably above the portion of the bottom surface 2 defining the groove 4.

Therefore, it can be understood that, with the prior art spinning rotor shown in FIG. 1, if it is designed to have a small differential angle $\alpha-\beta$ by increasing the angle $\beta$ in order to increase the yarn strength, the amount of accumulated impurities will be greatly increased. In other words, it is not possible to decrease the amount of collected impurities without decreasing the yarn strength.

In contrast to the above, with the spinning rotor according to this invention, since the yarn guide portion 2*a* of the bottom surface 2 defining the angle $\delta$ extends substantially in the same direction as the yarn taking-off direction and is positioned above the plane of rotation of the intersection y, the groove angle can be decreased from the value $\beta+\gamma$ to $\beta-\delta$ while maintaining the angle $\beta$ in the range which substantially exerts no adverse influence upon the yarn strength, and it is possible to eliminate any space in which the impurities can not be rolled into the yarn.

Figure 6:
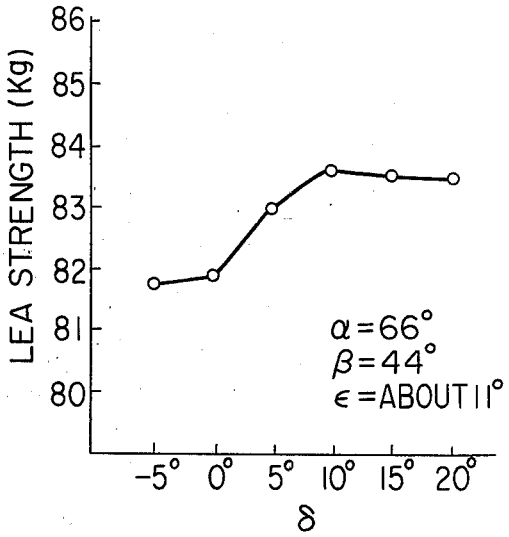
FIGS. 6 and 7 are graphs, corresponding respectively to FIGS. 4 and 5, showing experimental results obtained with respect to the spinning rotor of FIG. 3.
Figure 5:
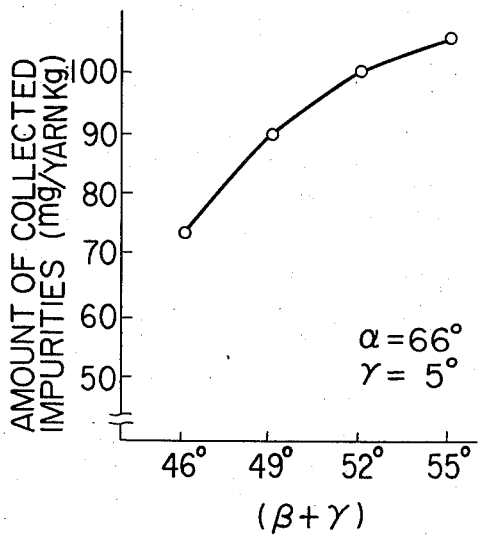
Figure 7:
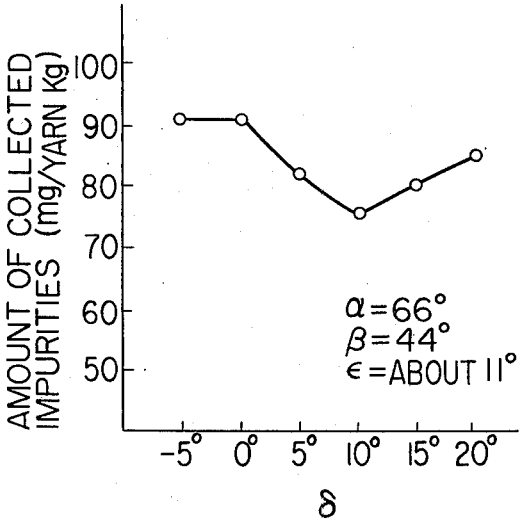

As apparent from FIG. 6, it can be stated with respect to the relationship between the angle $\delta$ and the yarn strength that the yarn strength has a tendency to increase if the angle $\delta$ exceeds the angle $\epsilon$ minus about 5°. Although satisfactory yarn strength was obtained even if the angle $\delta$ reached about 20°, the appearance of the yarn spun under this condition was impaired because of excessive contact between the yarn and the yarn guide portion 2*a* and because the yarn is relatively abruptly turned at the inner circumferential edge of the yarn guide portion 2*a*. With respect to the relationship between the angle $\delta$ and the amount of collected impurities, it was found, as apparent from FIG. 7, that the most favourable result was obtained at the angle $\delta=10°$ and significant effects were provided in the region where the angle $\delta=\epsilon\pm$ about 5°. An angle $\delta$ in excess of the angle $\epsilon+$ about 5° caused an increase in the amount of collected impurities. This is assumed to be due to the facts that, in this case, the contact between the twisted yarn and the yarn guide portion 2*a* becomes so strong as to impede the smooth "rolling-in" of the impurities into the twisted yarn and that the yarn strongly contacts the inner circumferential edge of the yarn guide portion 2*a* while being abruptly turned thereat thereby causing the "rolling-in" force not to be effectively transmitted toward the fiber collecting groove 4. In the case of the angle $\delta$ below the angle $\delta$ minus about 5°, the amount of collected impurities was increased because the space between the twisted yarn and the yarn guide portion 2*a* was developed to such an extent that the impurities could not be rolled in the yarn.

It will be apparent from the foregoing that the condition $\delta=\epsilon\pm$ about 5° constitutes the essential factor in providing a spinning rotor which can produce a yarn having high strength with the reduced accumulation of impurities therein, and in the case of $\delta=$ about $\epsilon$ the most favorable results can be obtained with respect to the yarn strength and the impurity accumulations when $\delta=$ about $\epsilon$.

Although the invention has been described with respect to an open end rotor of a self-air discharge type wherein air is discharged through openings provided in the bottom of the rotor, it is of course applicable to a rotor of a forced air discharge type.

What we claim is:

1. In an open end spinning machine comprising a spinning rotor having a fiber sliding surface in the form of a frusto-conical shape consisting of a first fiber sliding portion, onto which discrete fibers are first supplied, and a second fiber sliding portion connected to said first fiber sliding portion, a bottom surface, and a fiber collecting groove formed between said second fiber sliding portion and said bottom surface; and a yarn take-up tube centrally extending into said spinning rotor to take up a yarn therethrough, which is formed by collecting and twisting said supplied fibers in said collecting groove: the improvement wherein an angle ($\alpha$) formed by said first fiber sliding portion with respect to a plane of rotation of said spinning rotor is larger than an angle ($\beta$) formed with respect to said plane of rotation by said second fiber sliding portion, and a difference between an angle ($\delta$) formed with respect to said plane of rotation by a fiber guide portion of said bottom surface and an angle ($\epsilon$) included between said plane of rotation and a yarn taking off line connecting the lowermost point of said yarn take-up tube with an intersection of said second fiber sliding portion and said fiber guide portion is in the range of about $\pm 5°$.

2. The spinning machine according to claim 1, wherein the lowermost point of said yarn take-up tube is positioned on or on the rotor's open end side of a plane of rotation of a maximum diameter portion of said fiber collecting groove.

3. The spinning machine according to claim 2, wherein said fiber guide portion of said bottom surface is positioned on or on the rotor's open end side of said plane of rotation of the maximum diameter portion of said fiber collecting groove.

4. The spinning machine according to claim 1, wherein the angle ($\delta$) is equal to the engle ($\epsilon$).

5. The spinning machine according to claim 1, wherein the angle ($\alpha$) is 55° to 75° and the differential angle ($\alpha-\beta$) is 10° to 35°.

* * * * *